US006447165B1

(12) United States Patent
Grewe

(10) Patent No.: US 6,447,165 B1
(45) Date of Patent: Sep. 10, 2002

(54) SHIPPING CONTAINER THAT CAN BE STIFFENED

(75) Inventor: Andreas Grewe, Rheine (DE)

(73) Assignee: Eurea Verpackungs GmbH & Co. KG, Rheine (DE)

( * ) Notice: Subject to any disclaimer, the term of this patent is extended or adjusted under 35 U.S.C. 154(b) by 0 days.

(21) Appl. No.: 09/715,592

(22) Filed: Nov. 17, 2000

(30) Foreign Application Priority Data

Nov. 17, 1999 (DE) ..... 199 55 086

(51) Int. Cl.[7] ..... B65D 30/16

(52) U.S. Cl. ..... 383/121.1; 383/16; 383/18

(58) Field of Search ..... 383/24, 119, 121, 383/121.1, 67, 16, 18

(56) References Cited

U.S. PATENT DOCUMENTS

| | | | | |
|---|---|---|---|---|
| 3,282,621 A | * 11/1966 | Peterson | ..... | 383/67 X |
| 3,674,073 A | 7/1972 | Hendon | ..... | 383/18 |
| 4,479,243 A | * 10/1984 | Derby et al. | ..... | 383/121 X |
| 4,917,507 A | * 4/1990 | Davidson | ..... | 383/67 |

FOREIGN PATENT DOCUMENTS

| | | | | |
|---|---|---|---|---|
| DE | 2824929 | * 12/1979 | ..... | 383/24 |
| EP | 0084942 | 8/1983 | | |
| GB | 2161452 | * 1/1986 | ..... | 383/24 |

* cited by examiner

*Primary Examiner*—Jes F. Pascua
(74) *Attorney, Agent, or Firm*—Milde & Hoffberg, LLP

(57) ABSTRACT

The invention relates to a flexible shipping container (10) for bulk material, comprising a carrying bag (1) having a bottom (3) with at least one pocket (2.1, 2.2, 2.3) or flap (27) attached to it, such that a flat stiffening element can be inserted between the bottom and the pocket (2.1, 2.2, 2.3).

14 Claims, 6 Drawing Sheets

SHIPPING CONTAINER THAT CAN BE STIFFENED

BACKGROUND OF THE INVENTION

The invention relates to a flexible shipping container, particularly for bulk material, whose carrying bag consists of a bottom, at least one side wall, and a top wall and that is made of a flat-shaped article.

Such shipping containers that are typically made of synthetic fibers or of small synthetic bands and that include carrying loops as well as a fill and a discharge opening are used for purposes of transporting bulk material and are stored next to one another or on top of one another in a storage room by using a fork lift truck. To utilize the storage room to its full capacity, the dimensions of the shipping container are usually adapted to the interior dimensions of the storage space, e.g., a 20-foot container.

If the shipping container is lifted onto the storage surface or onto a shipping container that is already stored in the storage space by a fork lift, which has a lifting frame that has a sufficient support area, then, as is already known, the shipping container can be placed on a thin sheet that has been placed loosely onto the support area of the lifting frame. This achieves that the conventional pallets are no longer needed and that the load consisting of filled shipping containers can be stored more densely. In loading, one not only saves the bottom pallet but in stacking also the top pallet. The disadvantage is that the sheet that is positioned under the shipping container and that is known as a slip sheet does not have a good connection with the bottom of the shipping container and that the shipping container can slip off the sheet during manipulation with the lifting frame. An additional disadvantage is that additional handling steps are required for placing the sheet, such that another person is required for-loading in addition to the fork lift operator.

SUMMARY OF THE INVENTION

It is, therefore, a principal objective of the present invention to construct a shipping container of the type mentioned above that is better suited for loading with a fork lift, in particular for storage without pallets in a transport container, and where the expenditure of human labor during loading can be reduced, and where especially the disadvantages of slip sheets do not occur.

According to the invention, this objective is achieved in that the carrying bag of a shipping container includes at least one pocket or flap located at the bottom of the carrying bag such that a stiffening object can be placed between the bottom and the pocket or flap. The European Patent No. EP 0 084 942 A1 discloses a bulk material container having a pair of slings, which is opened and closed by a slide valve gate having handles at the opposed ends, and an off-center opening adapted to be placed into full or partial registration with the opening in the bottom wall of the container to control the flow of bulk material from the container. The known valve plate may stiffen the bottom of the container. However, there is no bag or pocket to hold a special stiffening plate as proposed with the invention.

The pocket or flap is created, according to the invention, by attaching at least one material section to the bottom of the carrying bag. Preferably, the pocket is made of the same material as the remaining part of the carrying bag.

Typically, the shipping containers are made of a high-strength fabric or knit of polymer strings, or small synthetic bands or of paper or synthetic foil.

If only one material section, that is, a flap is connected to the bottom, a simple pocket is created that can also be called a double bottom. The pocket exhibits a longitudinal opening in the area of one bottom edge of the carrying bag.

In a stronger design, for example, two material sections on top of one another may be connected to the bottom with three side seams forming a pocket.

It is possible to arrange two pockets next to one another in the bottom area of the carrying bag, with the pocket openings pointing to the outside.

Both the single and the double or multi-layer material section can project beyond the bottom edge and end in a free flap or pocket section that can be turned over at the edge and can be fastened in a detachable manner to the side wall of the carrying bag using suitable closures such as Velcro-type fasteners.

It is advantageous to connect the projecting pocket or flap section to the side wall with at least one flexible band, string or the like that can be used to keep the pocket or flap section in a slightly slanted position to the bottom plane when in the folded up position. During production of the carrying bag, the projecting pocket or flap section can be made of the material of the bottom as its extension. The pocket or flap can be stiffened through appropriate folding of the material (one or multi-layer).

The main purpose of the pocket that is attached to the bottom of the carrying bag is to replace the so-called slip sheet that is used to aid in pushing or pulling the filled shipping container, which is placed on the special front end of the fork lift.

The invention also relates to a shipping container equipped with such a sheet that is located in the pocket. It is preferable that after inserting the flat object, the pocket projects beyond the bottom edge of the carrying bag. In this manner, the projection can be grabbed by the fork lift and moved together with the shipping container.

The flat object can be made of sheet metal, a synthetic plate, laminated or wood material, cardboard or of textile materials. It is possible to provide the flat object with perforations (as in a perforated sheet). Preferably, the flat object is slightly bent or crimped.

The shipping container subject to the invention contributes to an about 10 to 20% increase in the storage capacity of a 20-foot container and to the fact that fewer people are required for loading. Furthermore, for a typical 20-foot container, the use of 20 to 40 pallets can be avoided. This results in lower shipping costs per weight unit and savings for pallet material (wood) and fuel. This saves natural resources and puts less stress on the environment.

The idea of the invention does not only relate to cube-shaped containers but also to cylindrical or prismatic ones. Further, the invention also relates to shipping containers made of high-strength synthetic foil, or textile materials such as linen, or of paper with one or two walls.

For a full understanding of the present invention, reference should now be made to the following detailed description of the preferred embodiments of the invention as illustrated in the accompanying drawings.

DESCRIPTION OF THE PREFERRED EMBODIMENTS

Figure 1:
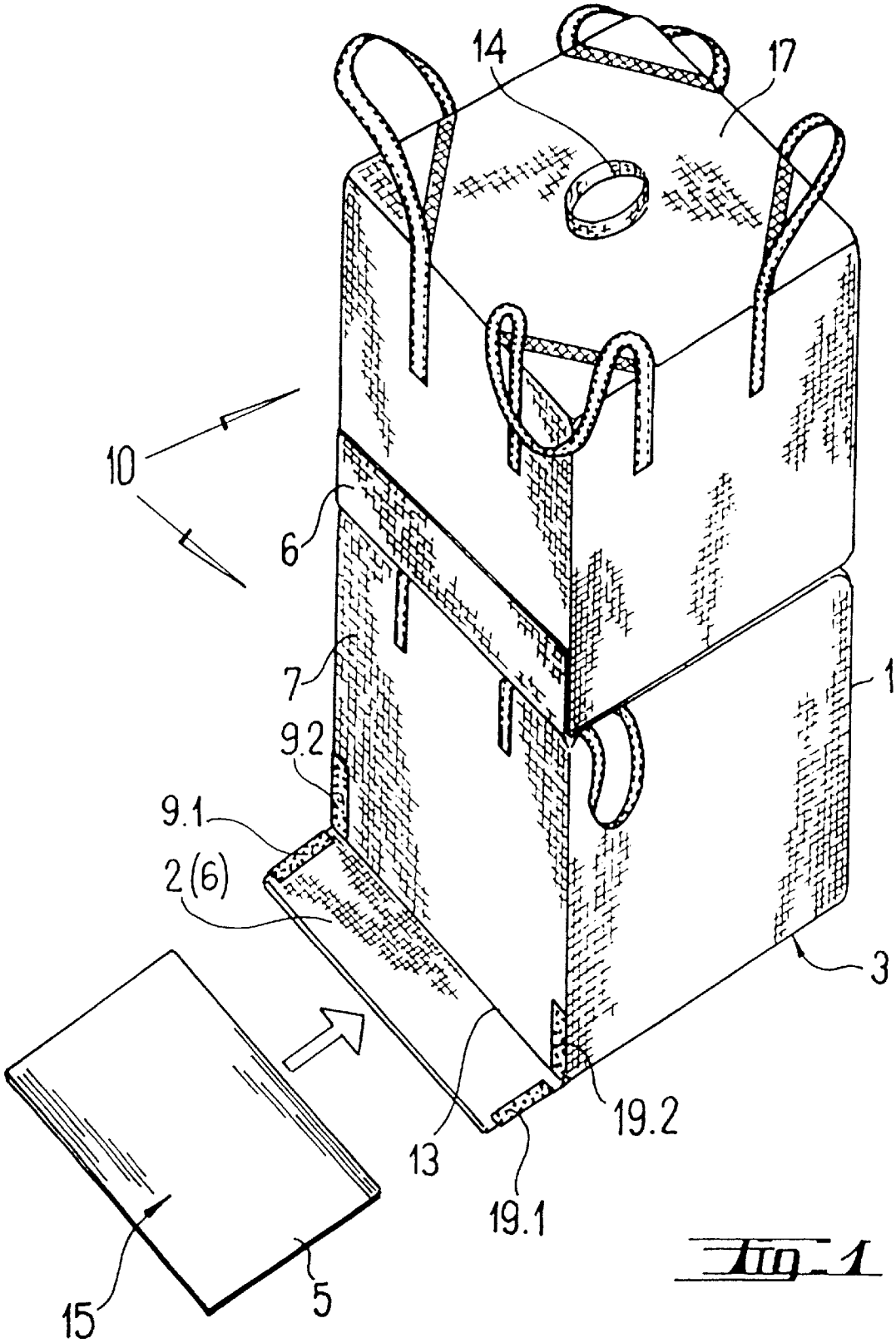
FIG. 1 shows a perspective view of two shipping containers, one on top of the other.

The preferred embodiments of the present invention will now be described with reference to FIGS. 1–8 of the drawings. Identical elements in the various figures are designated with the same reference numerals.

FIG. 1 shows two cubic shipping containers 10 (big bags) that are stacked on top of one another and that are filled with bulk material, where the carrying bags 1 of the shipping containers each comprise of a bottom 3, a top wall 17 and four side walls 7. The top wall 17 includes a filler opening 4 with a valve (not shown) and the bottom 3 (cf.

Figure 2:
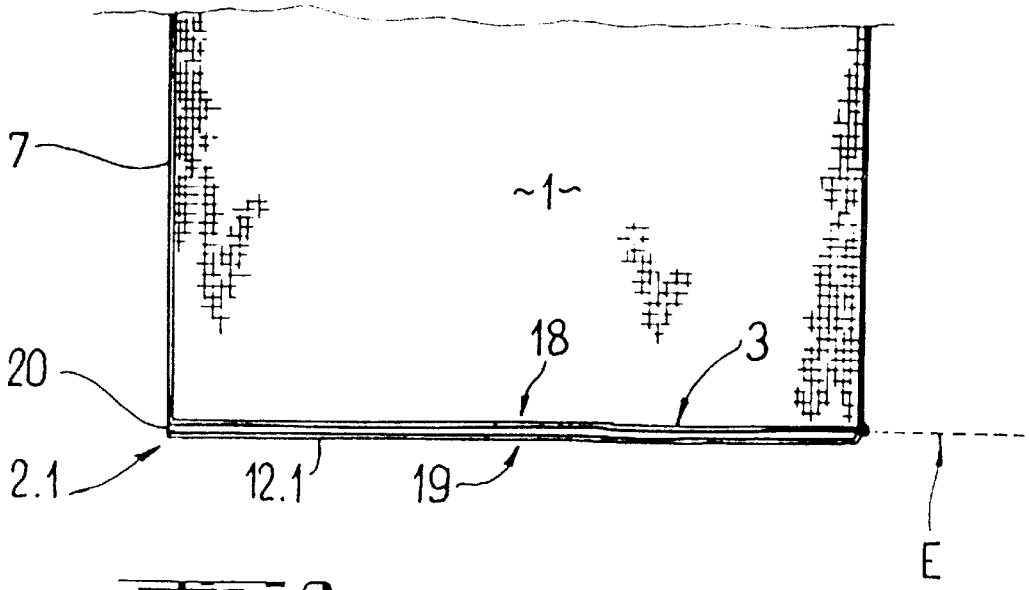
FIG. 2 shows a section of a first exemplary embodiment of a shipping container.
Figure 3:
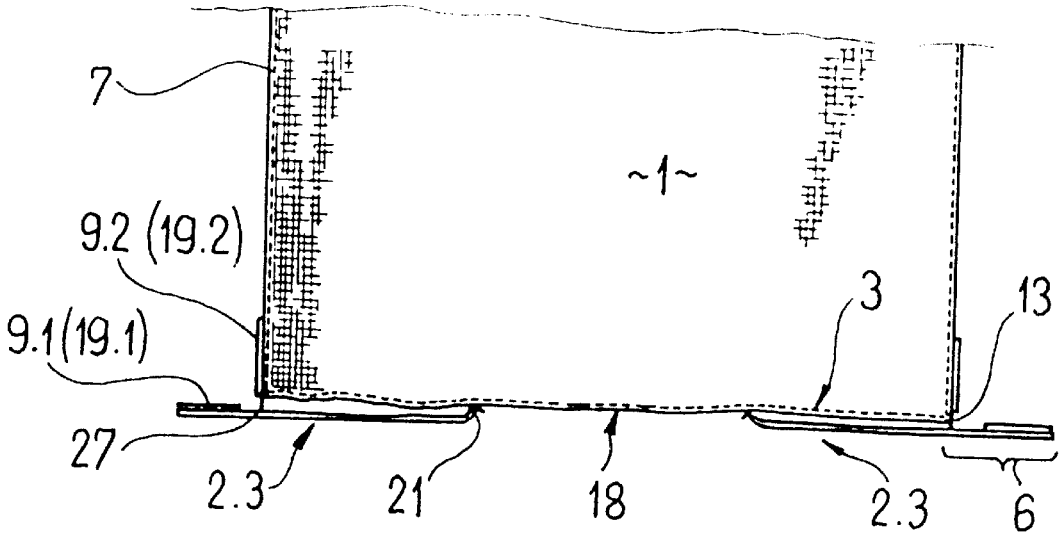
FIG. 3 shows a section as well of a second exemplary embodiment of a shipping container.

FIGS. 2 and 3) includes a discharge opening 18 that can be closed. Appropriate carrying devices in the typical shape of loops are attached to the carrying bag 1 as well. The walls of the shipping container 10 are made of a high-strength fabric or of small polypropylene bands.

According to FIG. 2, a material section 12.1 that forms a flat pocket 2.1 together with the bottom 3 is located across the entire area of the bottom 3 of the carrying bag 1. The material section 12.1 is sewn together with the bottom 3 at three of its edges, leaving one longitudinal pocket opening 20. The material section 12.1 also includes an opening 19 in its center. The carrying bag 1 shown in FIG. 3 exhibits two pockets 2.3 at opposite sides that are sewn together with the bottom 3 and that project beyond one bottom edge 13 and form a projection (pocket section 6). VELCRO hook and loop fastener elements 9.1, 9.2 and 19.1, 19.2 are attached to the flap section 6 and the side wall 7 such that the projection can be turned over around the bottom edge and can be fastened to the side wall 7 (cf. FIG. 1 top). As FIG. 3 shows, the two pockets 2.3 each reach to a seam 21 that runs outside the discharge opening 18.

Figure 4:
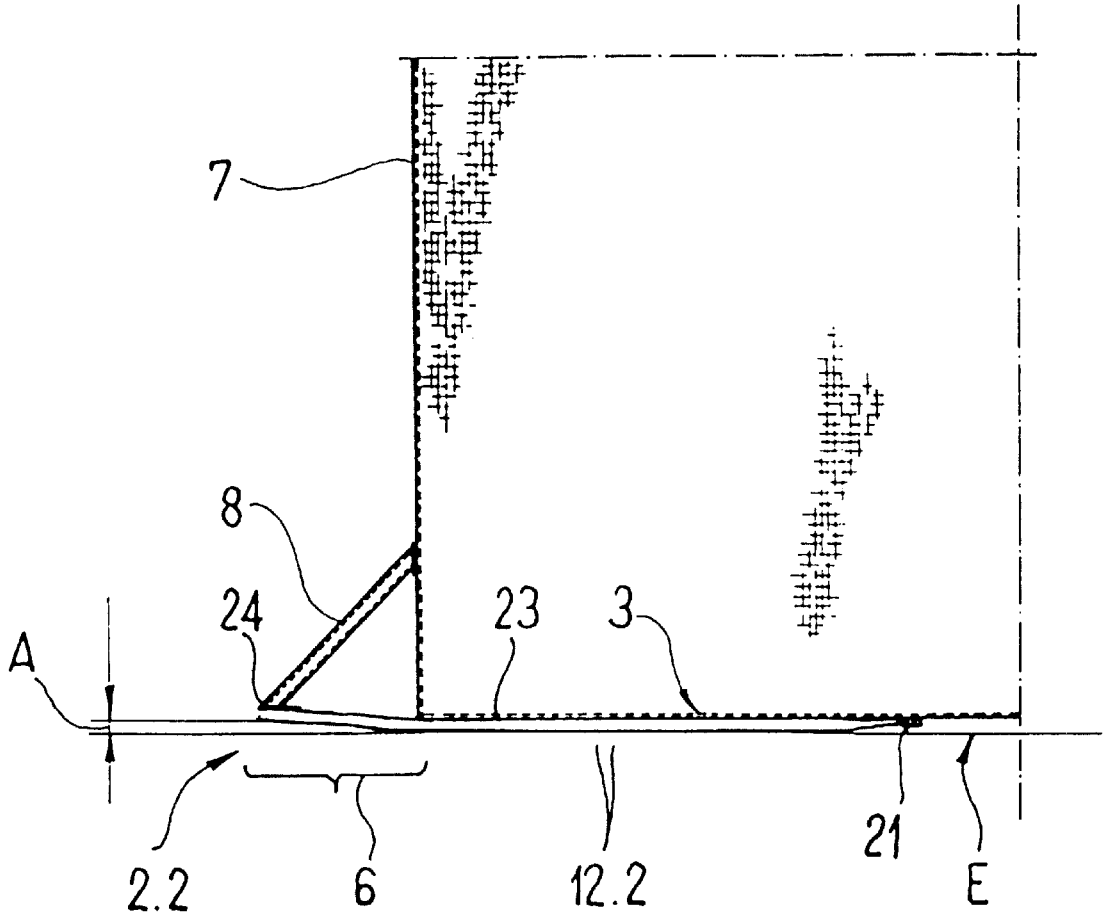
FIG. 4 shows the support of the free end of a pocket.
Figure 5:
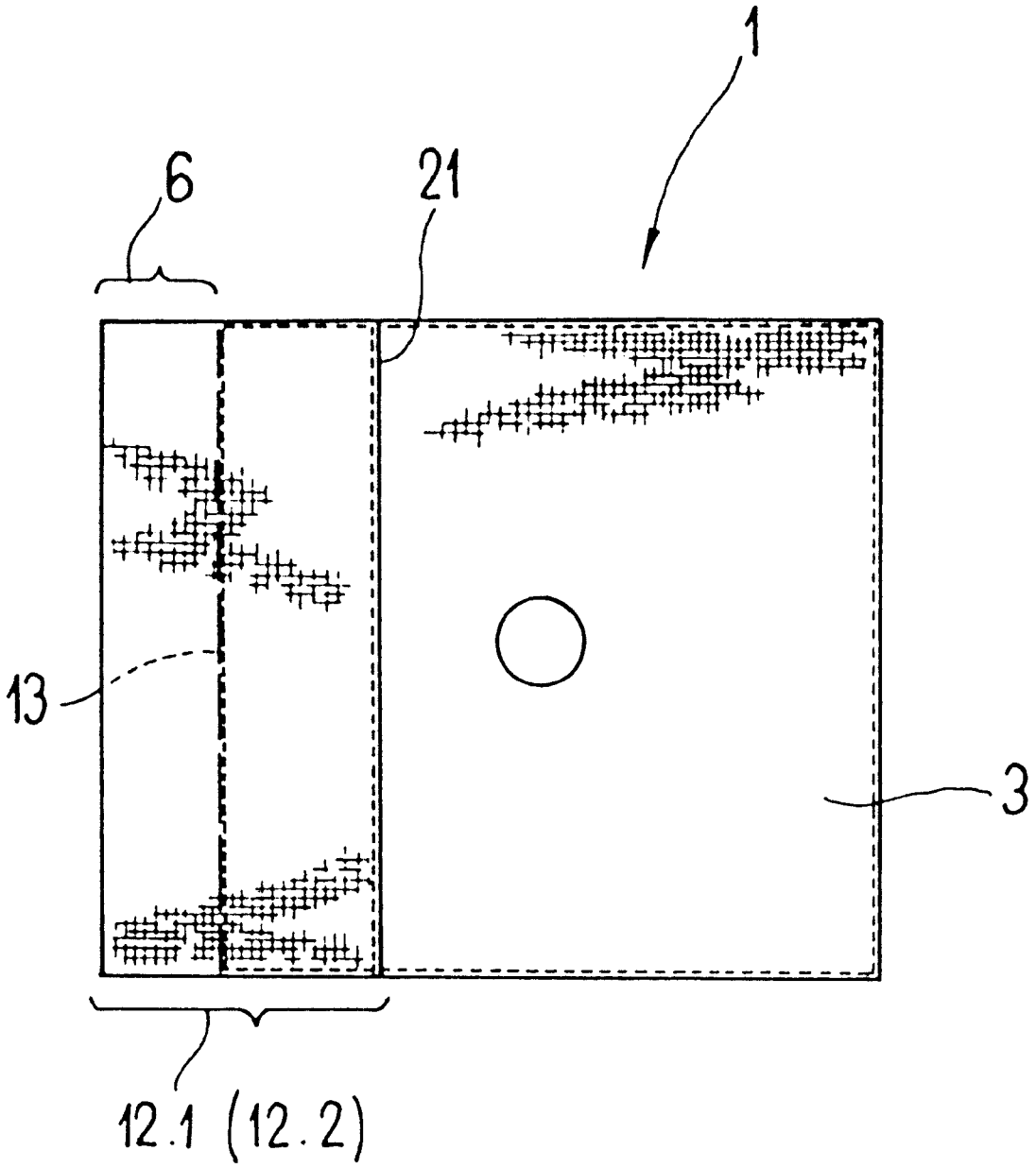
FIG. 5 shows the bottom view of the bottom of the shipping container with a pocket.
Figure 6:
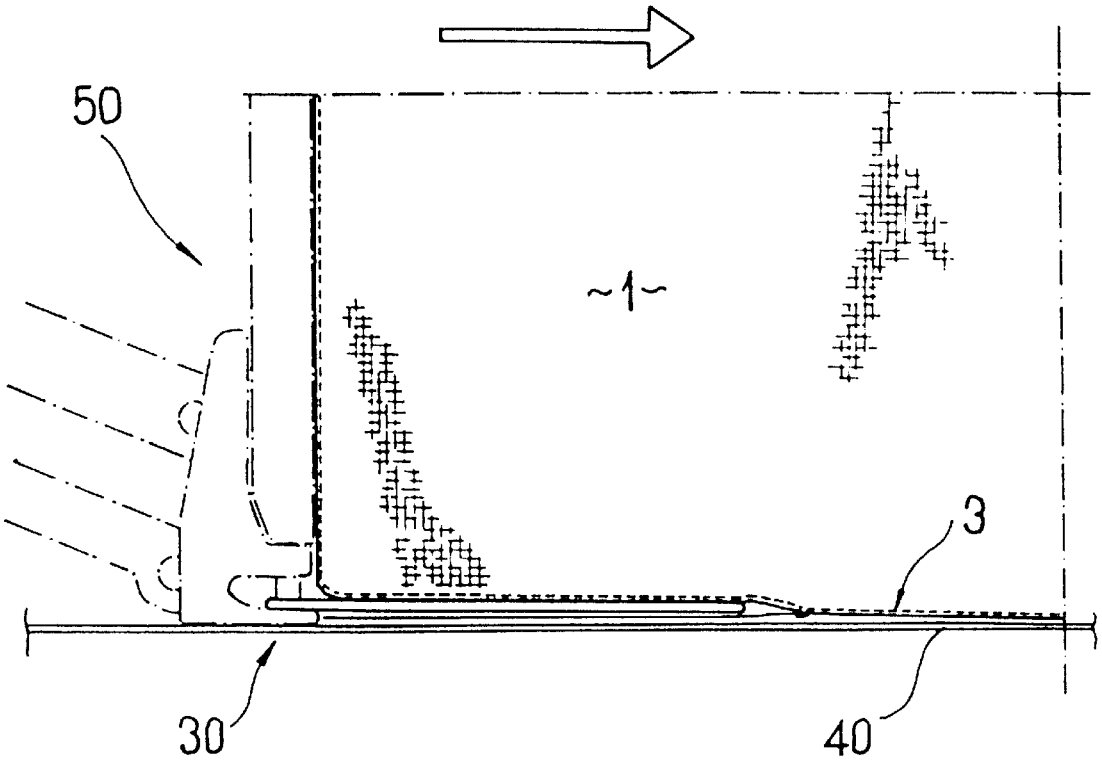
FIG. 6 shows a side view of the shipping container placed on a front end of a fork lift truck.

FIGS. 4 and 5 show an embodiment, where the seam 21 and two side seams 23 (the section in FIG. 4 shows only one side seam) connect the bottom 3 with two material sections 12.2 that are arranged one on top of the other. The material sections 12.2 form a pocket 2.2 with a projection (pocket section 6) whose free end 24 is connected to the side wall 7 with a band 8. The length of the band 8 is dimensioned such that the end 24 (in the side view) is slightly higher (reference A) than the bottom plane E. This has the result that a flat object 5 that is inserted into the pocket (cf. FIG. 6) can be grabbed by a clamping device 30 at the end that faces away from the carrying bag.

Figure 7:
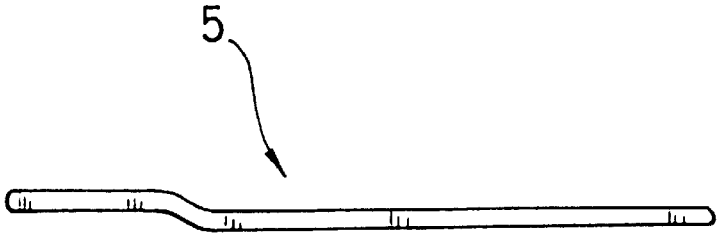
FIG. 7 shows a side view of a crimped flat object.
Figure 8:
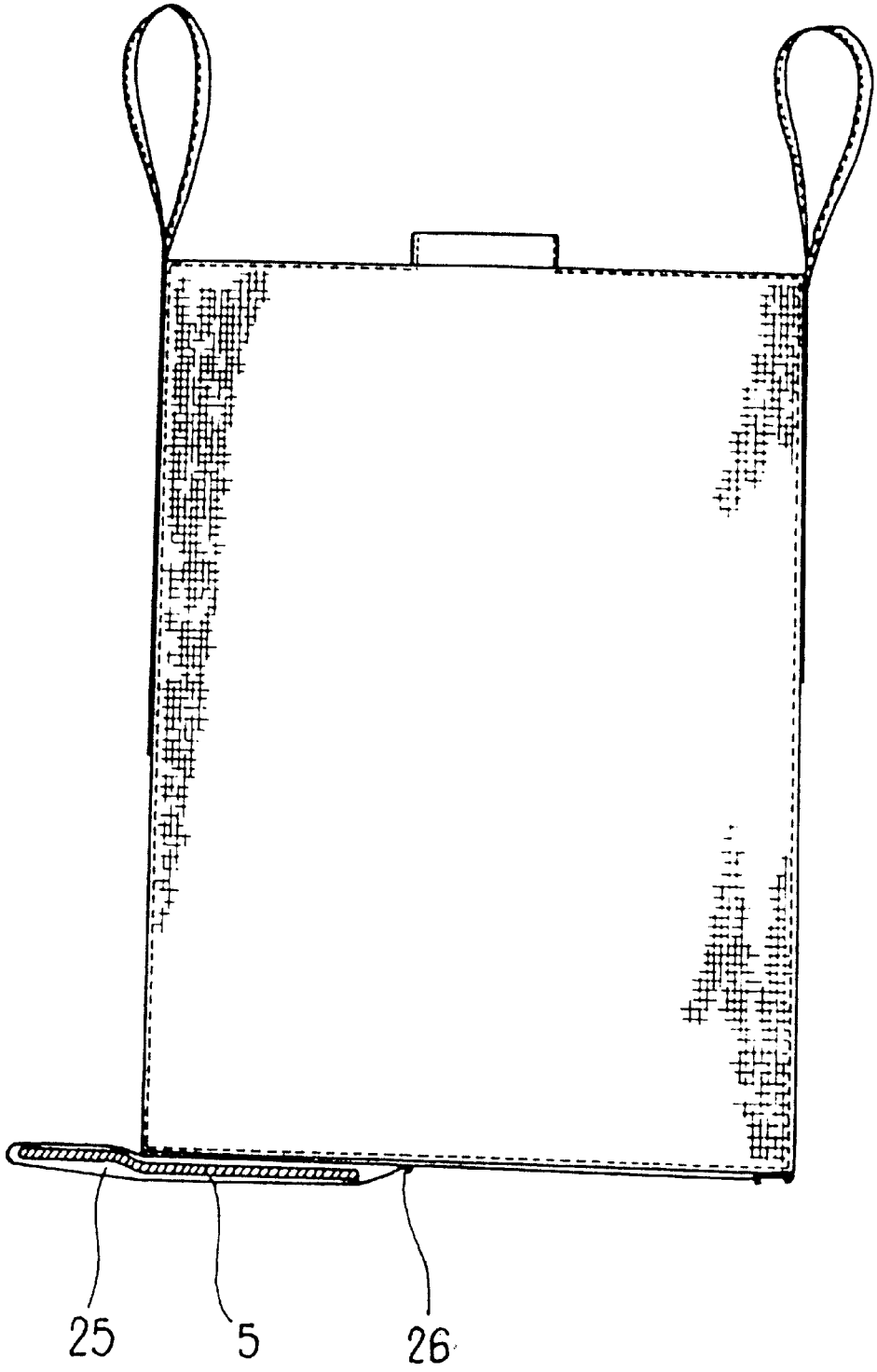
FIG. 8 shows a shipping container equipped with a crimped flat object.

FIG. 7 shows an advantageous design of the flat object 5. The flat object 5, made of a 3 mm thick, elastic synthetic plate is already crimped in its free non-loaded condition to ensure a secure hold for the clamping device of the fork lift. FIG. 8 shows a shipping container that is equipped with a crimped flat object. The shipping container includes an additional inner pocket 25 that has been formed by folding the projecting flap section 6 where the flat object is accommodated. The pocket 25 is sealed with a seam 26.

The loading Procedure:

A shipping container 10 that has a flat object 5 located in its pocket is filled and taken off a roller conveyor by a fork lift. The lift frame of the fork lift includes a support area (wide prongs 40, cf. FIG. 6) where the shipping container 10 rests. The flat object 5 is held by the clamping device 30 of the lift frame. Thereafter, the shipping container is placed in a 20-foot transport container (not shown) whereby the fork lift moves the shipping container to the back wall of the transport container or to the last shipping container that has been placed in the transport container. The fork lift lowers the prongs to the bottom of the transport container, or to the shipping container that stands in the transport container, and extends its scissors. This results in the fork lift rolling back and pressing against the shipping container with its frame 50. This not only pushes the shipping container from the fork lift but also places it precisely at its location. The same holds true for a shipping container that is to be placed on top of another already filled shipping container. The reverse procedure applies to emptying the transport container.

There has thus been shown and described a novel shipping container that can be stiffened which fulfills all the objects and advantages sought therefore. Many changes, modifications, variations and other uses and applications of the subject invention will, however, become apparent to those skilled in the art after considering this specification and the accompanying drawings which disclose the preferred embodiments thereof. All such changes, modifications, variations and other uses and applications which do not depart from the spirit and scope of the invention are deemed to be covered by the invention, which is to be limited only by the claims which follow.

What is claimed is:

1. Flexible shipping container, particularly for bulk material, comprising a carrying bag made of a flat material and having a bottom, at least one side wall, and a top wall, the improvement wherein the carrying bag further comprises at least one pocket or flap disposed on said bottom and a substantially flat stiffening element inserted between the bottom and the pocket or flap, and wherein the pocket or flap extends into a pocket or flap section which projects sufficiently far beyond an edge of said bottom allow it to be gripped by a mechanical grabber and wherein the stiffening element substantially fills the pocket or flap section and projects beyond the edge of said bottom.

2. Shipping container as set forth in claim 1, wherein the flat material of the carrying bag is selected from the group consisting of polymer fabric, polymer knit, synthetic bands, natural fibers and synthetic foil.

3. Shipping container as set forth in claim 1, wherein the pocket or flap is formed by attaching at least one section of material to the bottom.

4. Shipping container as set forth in claim 3, wherein the section of material is the same material as the rest of the bag.

5. Shipping container as set forth in claim 3, wherein the section of material is sewn to the bottom.

6. Shipping container as set forth in claim 1, wherein the pocket or flap section is adapted to be folded up at the bottom edge of the carrying bag and attached to a side wall of the carrying bag.

7. Shipping container as set forth in claim 6, wherein hook and loop fastening elements are arranged at the pocket or flap section and on the side wall of the carrying bag for attaching the respective elements together.

8. Shipping container as set forth in claim 1, wherein the pocket or flap section is connected to the side wall with at least one flexible band and thereby maintained in a slightly slanted position with respect to a plane defined by the bottom.

9. Shipping container as set forth in claim 1, wherein the pocket or flap is folded and forms an inner pocket at least in the area of the pocket or flap section.

10. Shipping container as set forth in claim 1, wherein the stiffening element is a substantially flat object inserted in the pocket or flap.

11. Shipping container as set forth in claim 10, wherein the flat object, after it is inserted in the pocket or flap, projects beyond a bottom edge of the carrying bag.

12. Shipping container as set forth in claim 1, wherein the flat object exhibits a smooth surface.

13. Shipping container as set forth in claim 11, wherein the flat object is crimped slightly.

14. Shipping container as set forth in claim 10, wherein the flat object is made of material selected from the group consisting of sheet metal, synthetic material, wood, laminated wood material, cardboard, a laminated textile material and a fitted textile material.

* * * * *